US006374417B1

(12) United States Patent
Stagnitta

(10) Patent No.: US 6,374,417 B1
(45) Date of Patent: Apr. 23, 2002

(54) FOOD HANDLING GLOVE

(76) Inventor: Thomas J. Stagnitta, 156-44 88th St., Howard Beach, NY (US) 11414

( * ) Notice: Subject to any disclaimer, the term of this patent is extended or adjusted under 35 U.S.C. 154(b) by 0 days.

(21) Appl. No.: 09/576,569

(22) Filed: May 22, 2000

(51) Int. Cl.[7] ..... A41D 19/00
(52) U.S. Cl. ..... 2/161.8; 2/16; 2/163
(58) Field of Search ..... 2/16, 20, 159, 2/160, 161.6, 161.7, 161.8, 163, 164, 167, 168

(56) References Cited

U.S. PATENT DOCUMENTS

| | | | | | |
|---|---|---|---|---|---|
| 1,416,001 | A | * | 5/1922 | Detwiler | 2/21 |
| 1,559,114 | A | | 10/1925 | Maranville | |
| 2,616,745 | A | | 11/1952 | Alston | |
| 2,895,139 | A | | 7/1959 | Compton | |
| 3,236,553 | A | | 2/1966 | Shrier | |
| 4,107,840 | A | * | 8/1978 | Kupperman et al. | 30/172 |
| D256,182 | S | | 8/1980 | Kupperman et al. | |
| 4,589,146 | A | * | 5/1986 | Taylor | 2/161 |
| 4,628,544 | A | * | 12/1986 | Erickson | 2/158 |
| 4,918,755 | A | * | 4/1990 | Kinnear | 2/161 |
| 5,200,263 | A | * | 4/1993 | Gould et al. | 428/323 |
| 5,799,331 | A | * | 9/1998 | Stewart | 2/159 |
| 5,864,885 | A | * | 2/1999 | Grinberg | 2/160 |
| 5,873,788 | A | * | 2/1999 | Hoffman | 473/205 |

* cited by examiner

*Primary Examiner*—John J. Calvert
*Assistant Examiner*—Katherine Moran
(74) *Attorney, Agent, or Firm*—Jordan and Hamburg LLP

(57) ABSTRACT

A glove structure is fittable to the hand of a user, and includes an outer surface of which presents a series of tiny protrusions, or teeth, on the fingers and palm area of suitable profile to hold a piece of meat or other cooked food product in place, particularly while slicing it with the other hand. During use, the wearer of the glove simply places his/her gloved hand on top of a roast or another unsliced piece of meat or the like, and the teeth are inserted a minimal distance into the surface of the roast, securing it in place during the slicing process. As a result, slippage of the piece being sliced, which has heretofore been a major source of painful cuts and abrasions to the hands and fingers, is significantly inhibited. The glove advantageously includes an insulated inner layer, made of a material providing enhanced comfort, and protecting the wearer's hand from heat and burns. The glove is also advantageously lightweight, cut-resistant, and resistance to the passage of liquids, to thereby insulate the wearer from moisture.

17 Claims, 3 Drawing Sheets

FOOD HANDLING GLOVE

BACKGROUND OF THE INVENTION

The present invention relates to a food handling glove, and, more particularly, to a glove useful for handling cooked meats and other like food products during slicing and preparation.

Professional chefs and food handlers invariably receive burns and cuts while preparing cooked food for their customers. Burns often result when removing food, such as roasts, briskets, and other types of meat which are prepared whole and carved or sliced after cooking, from the oven or stovetop, particularly when cooking with hot water or cooking oil. Subsequent preparation of such cooked foodstuffs, for example slicing into individual portions, requires that the large, cooked piece be secured, to allow safe and effective cutting. Fingers and hands can become scarred from burns and cuts that result from direct handling of cooked roasts and other type of meats heated to high temperatures, and from improper or unreliable securement of the food during cutting thereof.

Such securement has generally been heretofore accomplished by sticking a fork into the piece of meat to hold it in place during the slicing process. In addition to contributing to the incidence of cuts and abrasions to the hands and fingers, this method of securement can be messy, and invariably results in abrading and tearing of the meat. Meats, such as roasts and other cuts cooked whole in the above described manner, are generally sliced as needed on repeated occasions, and returned to a cooking vessel until further portions are again sliced form the remaining piece. Such repeated piercing of the meat with a fork for securement further exacerbates the problem of tearing and abrasion of the meat.

Although conventional safety gloves are available for protecting hands from burns and cuts, they are generally bulky, and usually are worn only for purposes of handling cooking vessels or food service equipment. Their practical use in preparation of cooked meats has therefore not been heretofore feasible.

Accordingly, it is an object of the invention to provide a food handling glove which overcomes the drawbacks of the prior art as they pertain to safe and reliable handling and securement of cooked meats and other heat-prepared foodstuffs.

It is a further object of the invention to provide a food handling glove which would protect a cook from painful burns to the hands and fingers and would increase the safety conditions in any professional kitchen.

It is yet a further object of the invention to provide a food handling glove designed to hold cooked meats firmly in place with one hand, while slicing the meat with the other hand.

It is still a further object of the invention to provide a food handling glove which is light weight, timesaving, practical, economical to produce and convenient and easy to use.

It is yet a further object of the invention to provide a food handling glove which provides a user with insulation against heat and moisture, and which can be washed to maintain a desired level of sanitation.

SUMMARY OF THE INVENTION

In accordance with these and other objects of the invention, there is provided a specially designed glove that eases the task of handling cooked meat and other like foodstuffs for slicing purposes. The invention finds application in both consumer and commercial kitchens. The food handling glove comprises a glove structure fittable to the hand of a user, an outer surface of which presents a series of tiny teeth extending from the fingers and palm area, and of suitable profile to hold a piece of meat or other cooked food product in place, particularly while slicing it with the other hand.

Briefly stated, the food handling glove in accordance with the invention is designed to effectively secure a piece of meat in place during the slicing process by the specially designed nature of the series of tiny protrusions (or teeth) incorporated onto its fingers and palm area. The user would simply place his/her gloved hand on top of a roast or other unsliced piece of meat or the like, causing the teeth to be embedded a minimal distance into the yieldable surface of the roast to secure it in place during the slicing process, advantageously without puncturing the surface, but rather compressively depressing the meat the being secured at each location in correspondence with the teeth. As a result, slippage of the piece being sliced, which has heretofore contributed greatly to the incidence of painful cuts and abrasions to the hands and fingers, would be significantly inhibited. Use of the glove according to the invention represents a safer and more effective alternative to using a fork to hold a piece of meat in place. Tearing and major abrading of the meat is also avoided, since use of a fork or other utensil, which invasively pierces the meat to a significant degree, is obviated by use of the glove. The glove is also easier to use and manipulate than a fork, and therefore saves time and effort in a kitchen.

In an embodiment in accordance with the invention, the glove which serves as a gripping device for holding onto and/or securing cooked meats during the slicing process, as described above, is advantageously provided with at least one thermal insulating layer which is effective for protecting a cook from receiving painful burns to the hands and fingers when handling hot meats and foodstuffs. Hot meat could be handled safely and firmly with the use of a glove in accordance with this embodiment. Use of such food handling glove would thereby increase the safety conditions and productivity in professional as well as consumer kitchens.

In a further embodiment in accordance with the invention, the aforementioned food handling glove includes a moisture barrier for preventing or inhibiting passage of liquids in contact with surface portions of the glove to the wearer's hand. Such feature achieves a greater comfort level, as well as providing further protection against burns when the liquid is hot.

In accordance with an advantageous further embodiment of the invention, the teeth provided on the fingers and palm regions of the glove are configured to have a profile which locally penetrates or, alternatively, simply compresses, a surface of the meat a minimal distance, i.e., far enough to provide the desired gripping effect, but not to an extent causing unnecessary abrading, roughening or tearing of the surface of the meat after extended periods of handling thereof. Furthermore, the teeth are advantageously configured to be free of barbed, hooked or other structure which might bind to the meat when gripping pressure is released after a slicing operation, and which might therefore tend to abrade the surface thereof.

It is contemplated that the food handling glove in accordance with various embodiments of the invention can be produced easily using conventional and readily available materials and manufacturing processes. No new production technology would be required, making its implementation commercially attractive. The moisture barrier layer of the glove, conveniently, although not necessarily, disposed as an intermediate layer, is produced of a suitable material, for example, rubber or polyvinylchloride. The innermost layer, in contact with the wearer's hand, is advantageously formed from insulated cotton or other soft natural or synthetic material that can be cut, sewn, or otherwise stitched as desired. A food handling glove so produced is easy to use, comfortable to wear, convenient, safe, and would provide a greater level of sanitation than using bare hands while handling food. Moreover, the glove is also lightweight, heat-resistant, and cut-resistant, providing further advantage to the wearer, whether in a commercial setting or when used by a household consumer. The glove in accordance with the invention could be produced commercially in small, medium, and large sizes, as well as in a variety of colors and styles, thereby further enhancing commercial appeal.

The above, and other objects, features and advantages of the present invention will become apparent from the following description read in conjunction with the accompanying drawings, in which like reference numerals designate the same elements.

DETAILED DESCRIPTION OF THE INVENTION

In its broadest sense, the invention comprises a specially designed glove that eases the task of handling cooked meat for slicing purposes. Such food handling glove comprises a glove structure fittable to the hand of a user, an outer surface of which presents a series of tiny protrusions extending from the fingers and palm area, each which presents a suitable profile to hold a piece of meat or other cooked food product in place, particularly while slicing it with the other hand. For purposes herein, the term "glove structure" is defined as any structure receivable and securable to the hand of the user such that the user's hand is at least partially shielded from contact from an article being held by or brought into supported contact with the gloved hand. The following embodiment utilizes a glove structure which entirely encloses the hand. However, it will be understood that such structure is not essential to practice of the invention, and that a structure only partially shielding the hand which achieves the gripping function as described is intended to be within the contemplated scope of the invention.

Figure 1:
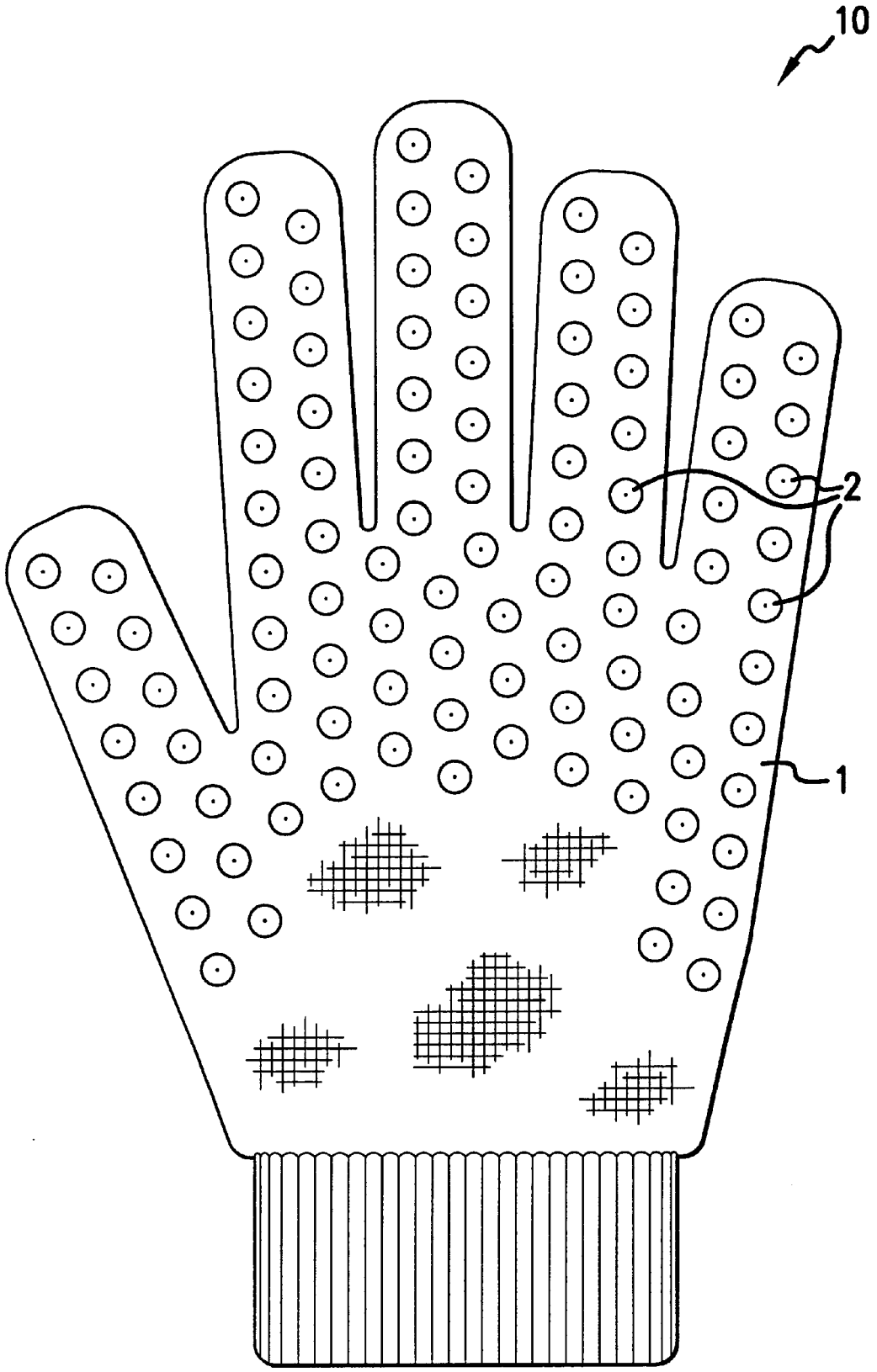
FIG. 1 is a front elevation of a food handling glove in accordance with an embodiment of the invention.
Figure 2:
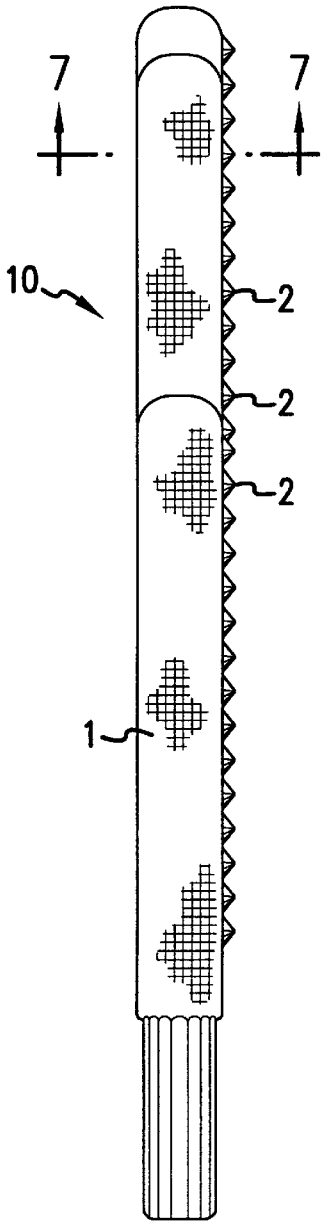
FIG. 2 is a side elevation of the food handling glove of FIG. 1.

Referring now to FIGS. 1 and 2, a food handling glove in accordance with an embodiment of the invention is depicted, and which is generally designated by the numeral 10. As shown, the glove 10 is comprised of a basic glove structure 1, conveniently of familiar design and shape, and which presents, on an outer surface thereof, a series of protrusions 2. As best seen in FIG. 2, the protrusions 2 extend outward of the outer surface of the glove structure 1, such that when a gloved hand grips or applies downward pressure on a piece of meat or the like, the flesh of the meat advantageously yields under the localized pressure points corresponding to the protrusions 2, thereby providing an enhanced grip of the piece of food. This allows facilitated cutting by a knife held in the other, ungloved hand. It is deemed particularly advantageous to practice of the invention, although not absolutely necessary, that the protrusions be configured with a shape and profile such that actual puncturing of the meat or other foodstuff by the protrusions 2 is avoided, and that the gripping action is effected by localized compression alone of the flesh in the areas of the protrusions 2. This feature obviates or significantly reduces abrading of the meat, even after carrying out repeated cutting operations.

In the depicted embodiment, the outer layer of the glove structure 1 is formed of a cut resistant synthetic fabric, such as SPECTRA and other similar materials presently employed in conventionally produced protective gloves. Use of such material in conjunction with features disclosed herein directed to providing enhance gripping of a large piece of meat provides the advantage of secure food handling and concomitant protection against accidentally received cuts from the cutting blade during the slicing operation.

Attachment of structure defining the protrusions 2 to the underlying glove structure 1 may be accomplished in any number of suitable ways determined by the skilled artisan at the time of practice of the invention, and as appropriately dictated by the precise nature of the materials used in the practical construction of the finished glove. The embodiment disclosed herein merely indicates one possibility of construction for purposes of illustrative disclosure. In accordance therewith, and as shown in FIG. 3, the fabric comprising the glove structure 1 is formed with a series of holes 3, an inner periphery of which is advantageously stitched or otherwise finished, by gluing, heat fusing (in the case of synthetic, meltable fabric), etc., to prevent fraying or unraveling of the woven fabric, in the manner, for example, of a button hole.

In the depicted example illustrating a possible attachment approach, the protrusions 2 are provided as part of a tack 5 which further presents a base 4 extending peripherally outward of the protrusions, and which is of larger dimension than the diameter of the holes 3 in the glove structure 1. When placed behind the fabric, i.e., on the side of the fabric closest to the hand of the wearer, the protrusions 2 thereby extend through the holes 3, while the tack 5 is prevented from passage thereto by the base 4. The tacks 5 are fastened to the fabric in suitable fashion, for example, by stitching (in a manner analogous to a conventional snap), or by gluing, fusing, molecular bonding, etc..

Figure 4:
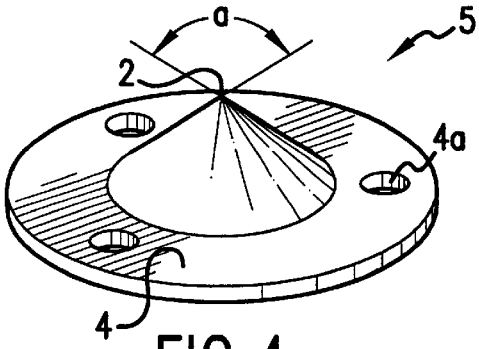
FIG. 4 is a perspective view of a tack on which is provided a protrusion of a configuration in accordance with the embodiments of FIGS. 1–3.
Figure 5:
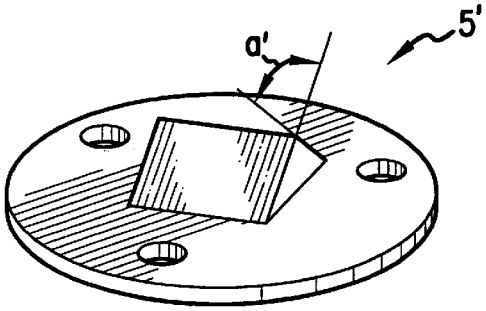
FIG. 5 is a perspective view of a tack on which is provided a protrusion of a configuration in accordance with an alternative embodiment.
Figure 6:
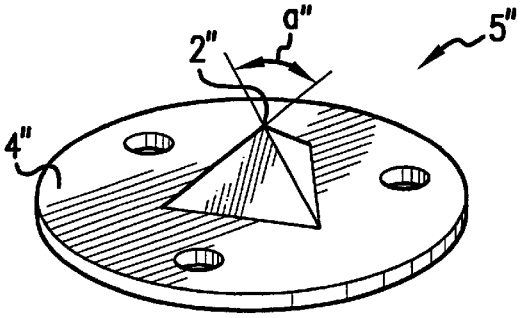
FIG. 6 is a perspective view of a tack on which is provided a protrusion of a configuration in accordance with an another alternative embodiment.

The protrusions 2 are of a suitable configuration which presents a profile advantageously achieving a compressive, yet nonabrasive/nonpuncturing effect at the localized points of contact with the meat being restrained. As such, the protrusions are advantageously free of barbed, hooked or other structure which might bind to the meat when gripping pressure is released after a slicing operation, and which might therefore tend to abrade the surface thereof. Furthermore, structure presenting undercuts is also advantageously avoided to limit trapping of food particles, for improved sanitation and cleanliness. Several possible configurations for the protrusions 2 are illustrated in FIGS. 4–6. It is not intended that the invention be limited to these configurations, since it is recognized that there exist a myriad of alternative shapes and profiles, which are deemed within the intended scope of the invention.

Figure 3:
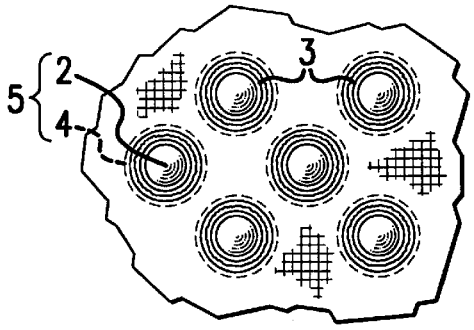
FIG. 3 is a detail view of protrusions extending from an outer surface of the food handling glove of FIGS. 1 and 2.

Turning now to FIG. 4, the protrusion 2 in accordance with the embodiment depicted by FIGS. 1–3 is shown to have a generally conical shape, advantageously of a low profile (i.e., height to diameter ratio) to prevent puncture or abrasion of the meat with which it is brought into compressive contact. As depicted, the base 4 contains holes 4*a* which permit stitching of the tack 5 to the fabric for fastening purposes, as described above.

FIGS. 5 and 6 depict examples of alternative protrusion configurations. In FIG. 5, a protrusion 2' carried on a tack 5' (of analogous design to tack 5 of FIG. 4) is shaped like a triangular prism. A tack 5" shown in FIG. 6 presents a protrusion 2" in the general shape of a pyramid. It is noted that a base 4" does not have holes, highlighting the concept that the tack 5" (or any of the other tacks) may be glued or welded to the fabric as an alternative to stitching.

It is deemed advantageous that the protrusions 2, 2', 2" each present a solid apex angle sufficiently large to discourage localized puncture of the meat being handled. As used herein, the term "solid apex angle" is defined as the angle at which the sides meet at the apex of the protrusions, and are identified by the designators a, a' and a" in FIGS. 4, 5 and 6, respectively. It will be understood that this term only applies strictly to protrusions presenting straight sides, as shown in the depicted examples. However, the general considerations will also apply to other configurations used for the protrusions in accordance with practice of the invention having curved surfaces, insofar as it will be appreciated that a relatively long, narrow, pointed structure will likely have the tendency of invasively puncturing and penetrating a surface of the meat when hand pressure is applied thereto. An advantageous range of solid apex angles is between about 45° and 135°. It is further envisioned that the protrusions are advantageously of relatively low profile, having a preferred height not exceeding about 5 mm from the outer surface of the glove, and more preferably a height which is in a range of about 2–4 mm, such that puncturing or otherwise invasive piercing of the meat is discouraged.

The material used for forming the protrusions can be any suitable, nontoxic and stable material advantageously having sufficient hardness to resist significant deformation when compressed against the meat being held. It is preferred that the protrusions be fashioned of a substantially non-flexible material, such that they do not yield to locally applied counter-pressure exerted by the meat when same is secured. Any number of suitable plastics and metals, for example, represent viable possibilities.

In a particularly advantageous embodiment of the food handling glove in accordance with the invention, the glove which serves as a gripping device for holding onto and/or securing cooked meats during the slicing process, as described above, is advantageously provided with at least one thermal insulating layer which is effective for protecting a cook from receiving painful burns to the hands and fingers when handling hot meats and foodstuffs. Hot meat could be handled safely and firmly with the use of a glove in accordance with this embodiment. An optional moisture barrier for preventing or inhibiting passage of liquids in contact with surface portions of the glove to the wearer's hand could further be provided. Such feature achieves a greater comfort level, as well as providing further protection against burns when the liquid is hot.

Figure 7:
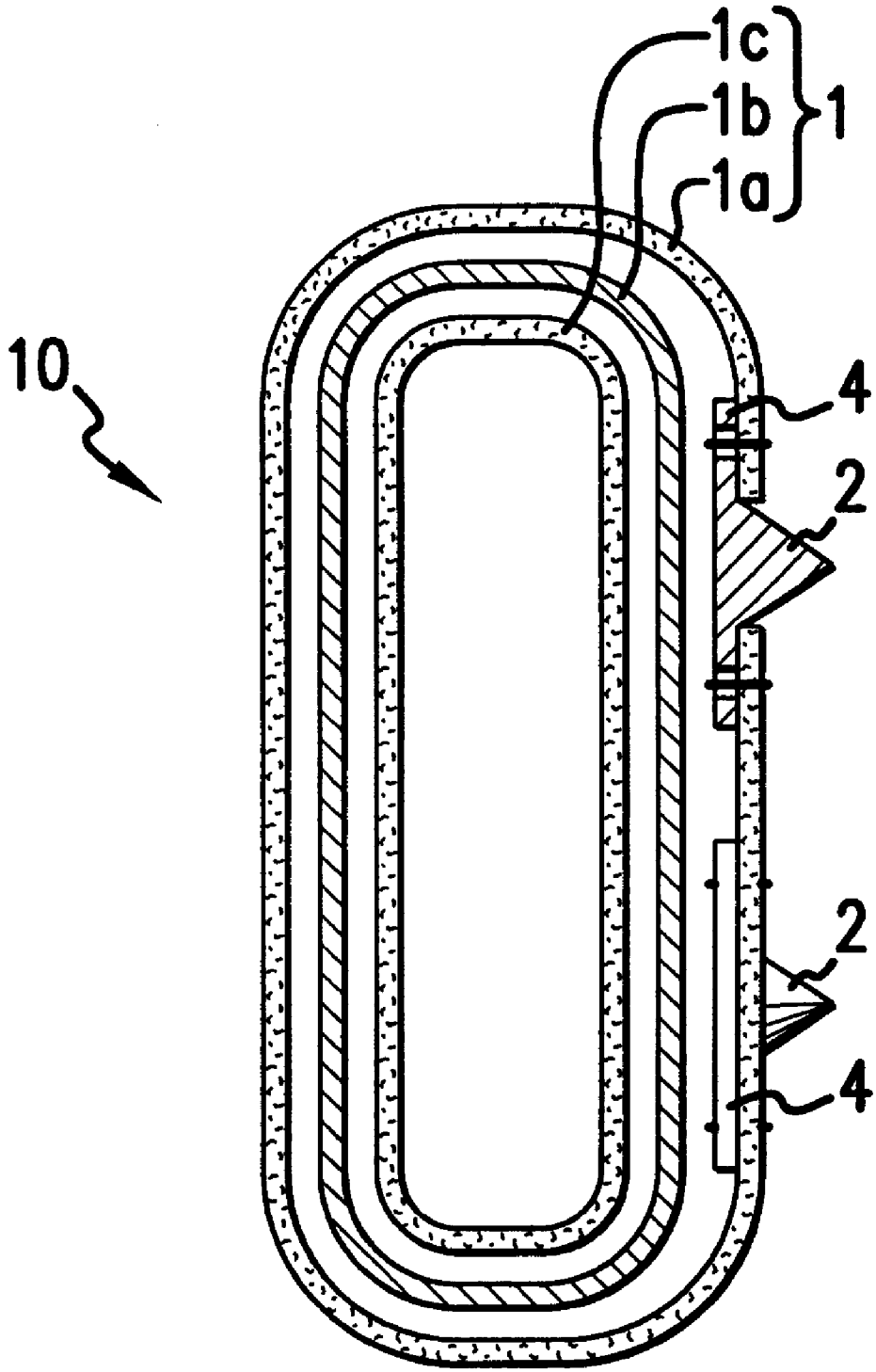
FIG. 7 is a cross-sectional view taken on line 7—7 of FIG. 1.

Referring now to FIG. 7, such additional layers are depicted, as represented in a cross-sectional view of a finger portion of the glove 10 of FIG. 1. In the example shown, the moisture barrier 1*b* is interposed between an outer cut-resistant outer layer 1*a*, and an inner, soft fabric thermally insulating layer 1*c*, in the form, for example, of a THINSULATE woven fabric or other insulation suitably used as a heat barrier. The three layers collectively define the glove structure 1, and are advantageously affixed to one another, for example along a cuff of the glove 1, to prevent separation of the glove structure into separate elements during machine washing and the like. The respective relative positions of layers 1*a*, 1*b* and 1*c* can be changed without departure from the invention. For example, the moisture barrier can be in the outermost position, and the protrusions affixed to an outer surface thereof by suitable technique, such as by gluing and bonding, to maintain the integrity of the moisture seal. It is noted that the glove 1 in accordance with the invention can be laundered as necessary to maintain proper sanitation and healthful appearance to customers.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A food handling glove, comprising:

a glove structure receivable to a hand of a user such that a palm side of the user's hand is shielded from contact with an article of food secured thereby over at least an area portion of said glove structure overlaying said palm side; and substantially rigid protrusions extending outwardly of an outermost surface of said area portion, said protrusions being dimensioned to provide localized pressure points which serve to secure an article of food when hand pressure is applied thereto while concomitantly reducing incidence of invasive puncturing a surface of the article thereby, a height of said protrusions measured from the outermost surface of the glove structure lying in a range of about 2 mm to about 5 mm.

2. A food handling glove according to claim 1, wherein said glove structure presents an enclosing structure substantially enveloping the hand received therein.

3. A food handling glove according to claim 1, wherein said glove structure includes an outermost layer formed of a cut resistant fabric.

4. A food handling glove according to claim 1, wherein at least one of said protrusions is of a generally conical configuration.

5. A food handling glove according to claim 1, wherein at least one of said protrusions is of a generally pyramid-shaped configuration.

6. A food handling glove according to claim 1, wherein at least one of said protrusions is configured generally as a triangular prism.

7. A food handling glove according to claim 1, wherein said glove structure includes a moisture barrier for inhibiting passage of liquids from an outside environment to at least the palm side of the hand of the user.

8. A food handling glove according to claim 1, wherein said glove structure includes a thermal layer for shielding at least the palm side of the hand of the user against extreme temperatures of food being handled.

9. A food handling glove according to claim 1, wherein said protrusions are structurally configured to present a solid apex angle in a range between about 45° and about 135°.

10. A food handling glove according to claim 1, wherein said protrusions are comprised of a substantially non-flexible material.

11. A food handling glove, comprising:

a glove structure receivable to a hand of a user such that a palm side of the user's hand is shielded from contact with an article of food secured thereby over at least an area portion of said glove structure overlaying said palm side said glove structure including an outermost layer formed of a cut resistant fabric, an innermost layer of cushioning material having thermally insulative properties, and a moisture barrier layer interposed between said outermost layer and said innermost layer; and substantially rigid protrusions extending outwardly of an outermost surface of said area portion, said protrusions being dimensioned to provide localized pressure points which serve to secure an article of food when hand pressure is applied thereto while concomitantly reducing incidence of invasive puncturing a surface of the article thereby.

12. A food handling glove according to claim 11, wherein a height of said protrusions measured from the outermost surface of the glove structure does not exceed about 5 mm.

13. A food handling glove according to claim 11, wherein a height of said protrusions measured from the outermost surface of the glove structure lies in a range of about 2 mm to about 4 mm.

14. A method of securing a piece of food, comprising:

providing a glove structure on a hand of a user such that a palm side of the user's is shielded from contact with an article of food secured thereby over at least an area portion of said glove structure overlaying said palm side, said glove structure including substantially rigid protrusions extending outwardly of an outermost surface of said area portion, said protrusions being dimensioned to provide localized pressure points which serve to secure an article of food when hand pressure is applied thereto while concomitantly reducing incidence of invasive puncturing a surface of the article thereby; and applying pressure to the piece of food with a gloved hand to effectively secure same during preparation.

15. A food handling glove according to claim 14, wherein at least one of said protrusions is configured generally as one of a triangular prism and a pyramid.

16. A method according to claim 14, further comprising shielding at least the palm side of the hand of the user from an elevated temperature of the piece of food by including a thermal layer in said glove structure.

17. A method according to claim 14, further comprising inhibiting passage of liquids from an outside environment to at least the palm side of the hand of the user by including a moisture barrier in said glove structure.

* * * * *